United States Patent [19]

Stewart et al.

[11] 3,962,764

[45] June 15, 1976

[54] METHOD OF INSTALLING A MOUNT ASSEMBLY IN A MULTI-BEAM CATHODE RAY TUBE

[75] Inventors: John Franklin Stewart; Raymond Arthur Alleman; Morris Robert Weingarten, all of Lancaster, Pa.

[73] Assignee: RCA Corporation, New York, N.Y.

[22] Filed: Jan. 15, 1975

[21] Appl. No.: 541,087

[52] U.S. Cl. ..... 29/25.13; 316/23

[51] Int. Cl.[2] ..... H01J 9/18

[58] Field of Search..... 29/25.13, 25.15, 25.16; 316/23; 29

[56] References Cited

UNITED STATES PATENTS

| | | | |
|---|---|---|---|
| 1,724,831 | 8/1929 | Fagan et al. | 316/23 |
| 3,807,006 | 4/1974 | Segro et al. | 29/25.13 |

*Primary Examiner*—Roy Lake
*Assistant Examiner*—James W. Davie
*Attorney, Agent, or Firm*—Glenn H. Bruestle; William H. Murray

[57] ABSTRACT

A bulb assembly, including a faceplate panel portion, and a mount assembly, comprising a stem and a multi-beam electron gun assembly, are positioned in axial alignment on respective central longitudinal axes. A reference plane which contains the central longitudinal axis of the bulb assembly and a major axis of the panel portion, is established. An orientation plane is then defined with reference to the structure of the electron gun assembly. The orientation plane is parallel to the central longitudinal axis of the mount assembly and includes two reference points on the structures of the electron gun assembly. The mount assembly is then rotated with respect to the bulb assembly on the coincident longitudinal axes until the orientation plane is at a prescribed angle with respect to the reference plane as optically indicated by the relative position of the two reference points with respect to each other. Then, while maintaining this rotational orientation, the mount assembly is axially moved within the bulb assembly to a desired longitudinal location with respect to the faceplate panel portion. The bulb assembly and mount assembly are then permanently assembled.

10 Claims, 10 Drawing Figures

METHOD OF INSTALLING A MOUNT ASSEMBLY IN A MULTI-BEAM CATHODE RAY TUBE

BACKGROUND OF THE INVENTION

This invention relates to a method of assembling a cathode ray tube bulb assembly and mount assembly, and particularly to a method of assembling an in-line multibeam electron gun assembly in a color television picture tube bulb of the phosphor line screen type.

In a commercial color television picture tube of the apertured mask type having a three-color viewing screen structure, the viewing screen structure is photographically printed using light centers simulative of the position of the deflection center of each of the three electron beams in the final tube. A mount assembly comprising a three beam electron gun is subsequently installed in the tube. During the assembly of the electron gun structure in the final tube, the axis of each cathode must be oriented to coincide with the light centers used to print the viewing screen structure within a desired rotational tolerance about the central longitudinal axis of the tube. In commercial color television picture tubes using dynamic convergence circuitry, a mount assembly including an electron gun assembly having three cathodes in fixed orientation ordinarily must be positioned in the tube within three degrees of rotation. In a commercial color television picture tube using no dynamic convergence circuitry or simplified dynamic convergence circuitry, a more accurate rotational positioning of the mount assembly is usually required.

In one prior method for assembling a multi-beam electron gun structure, the alignment is accomplished by two separate assembly operations. During the mount assembly operation, the central longitudinal axis of the electron gun assembly is aligned with the stem axis and the cathode axes are rotationally aligned with the stem leads. Then, the electron gun assembly is attached to the stem leads with metal wires and ribbons to form a mount assembly. In the subsequent mount sealing operation, the preassembled mount assembly is positioned and oriented with respect to the bulb assembly and then sealed to the bulb assembly on a sealing unit. The sealing unit holds and orients the bulb assembly rotationally with respect to the major and minor axes and axially with respect to the longitudinal axis of the bulb assembly. The sealing machine also holds and orients the mount assembly axially with respect to the stem, and rotationally with respect to the stem leads. Although this method of alignment is suitable for angular positioning of a mount assembly in some types of cathode ray tubes, it is not sufficiently accurate for others.

In the mount sealing operation, the mount assembly is held rotationally with the stem leads positioned within aligned holes on the sealing machine. Since the holes include a clearance for loading and the mount assembly includes assembly tolerances, the rotational alignment of the mount assembly with respect to the screen structure can only be maintained within three degrees of rotation. In addition, since the mount assembly is preassembled and transported to the sealing machine, the fragile wires supporting the electron gun assembly may be accidentally bent thereby misaligning the electron gun assembly with the stem leads. This may result in an angular misalignment of the electron gun assembly when the stem leads are used to angularly align the bulb assembly and the mount assembly. Furthermore, gauging the amount of angular rotation of the preassembled mount assembly after assembly and gauging the amount of angular rotation of the mount assembly in the assembled tube may be required to assure accurate rotational positioning of the electron beam axes with respect to the viewing screen structure in the finished tube.

In another prior method for assembling a multibeam electron gun structure, as described in U.S. Pat. No. 3,807,006 issued to Segro et al., the alignment is accomplished by mechanically sensing the position of the electron gun assembly with respect to the bulb assembly. While this method is an improvement in that it obviates the necessity to align the electron gun assembly with the stem axis which is in turn aligned with respect to the bulb assembly, this method entails the necessity of physically contacting the electron gun assembly thereby introducing its own errors into the total alignment error. These additional errors are caused by, for example, failure of the alignment gauges to properly contact the electron gun assembly; temporary rotational displacement caused by the actual contacting of the gun assembly during the alignment procedure, such temporary rotational displacement causing an alignment error when the alignment gauges are retracted prior to insertion of the stem assembly into the bulb assembly; and failure to provide a properly aligned contact surface on the electron gun assembly itself, that is, the axes of the beam forming apertures may not be properly aligned with respect to the contacted alignment surface.

SUMMARY OF THE INVENTION

A method of assembling a cathode ray tube having a bulb assembly and a mount assembly comprises the following steps. First the bulb assembly is positioned in a predetermined orientation. Next, the mount assembly, which includes a multi-beam electron gun assembly, is positioned in a location spaced from the bulb assembly with the central longitudinal axis of the mount assembly coincident with the central longitudinal axis of the bulb assembly. Next, the rotational position of the electron gun assembly about the coincident longitudinal axes is optically sensed with respect to the positioned bulb assembly. The mount assembly is then rotated about the coincident longitudinal axes until the electron gun assembly is at a prescribed rotational orientation with respect to the bulb assembly. Then, while maintaining this rotational orientation, the mount assembly is moved along the longitudinal axis to a desired longitudinal location with respect to a faceplate panel of the bulb assembly at which time the mount assembly is then permanently fixed to the bulb assembly.

DETAILED DESCRIPTION

Figure 1:
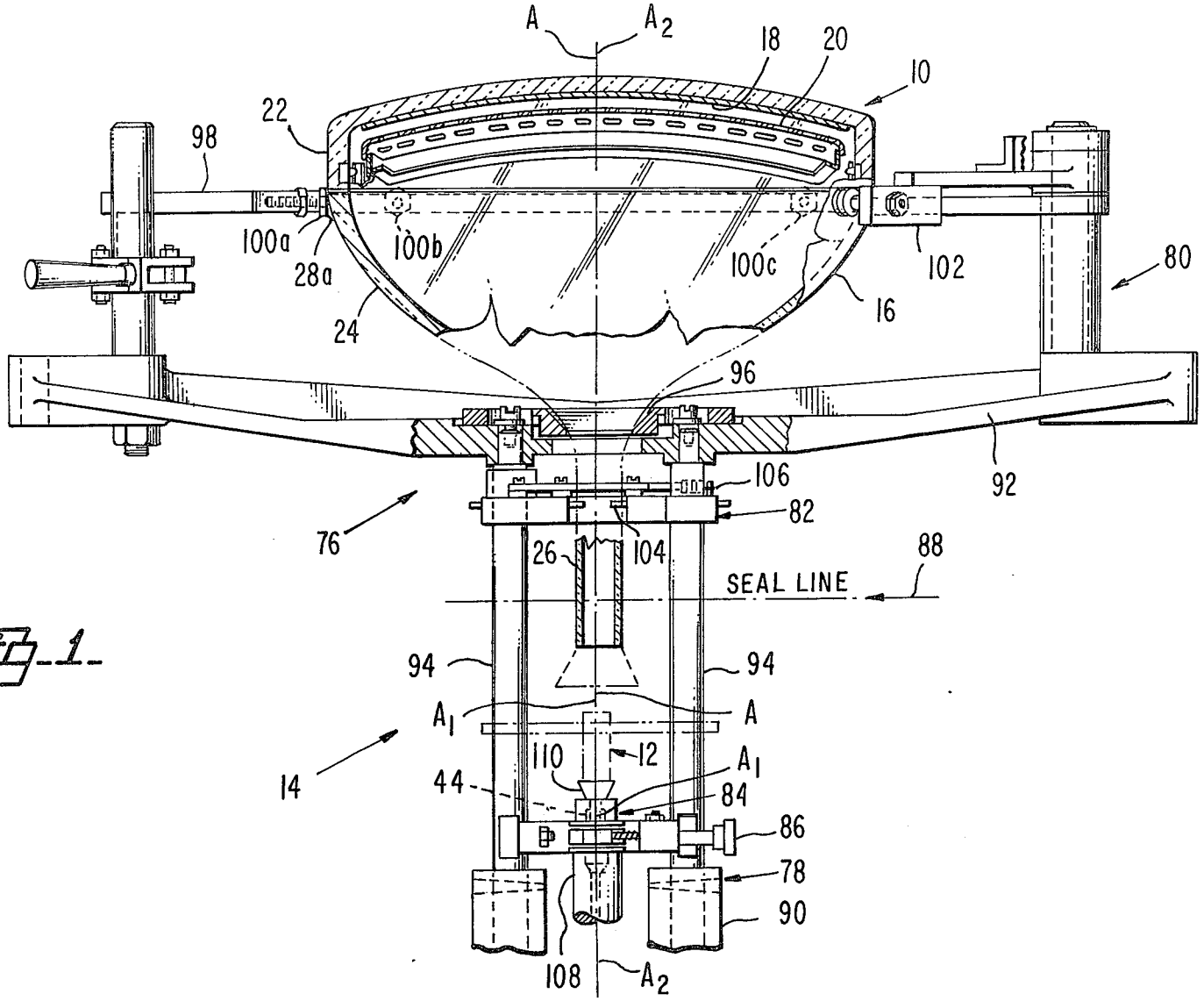
FIG. 1 is a broken-away sectional view of a bulb assembly and a mount assembly for a cathode ray tube positioned on a head assembly of a mount sealing unit.

FIG. 1 illustrates a sectional view of a bulb assembly 10 and a mount assembly 12 for a color television picture tube of the apertured-mask type positioned on an apparatus known in the art as a mount sealing unit 14 (only partially shown). The mount sealing unit 14 is used to install the mount assembly 12 in a precise location and orientation within the bulb assembly 10 to make a color television picture tube assembly. The bulb assembly 10 includes a central longitudinal axis A—A and the mount assembly 12 includes a central longitudinal axis $A_1$—$A_1$.

A color television picture tube bulb assembly 10 comprises a glass envelope 16, a three-color phosphor viewing screen structure 18 and an apertured-mask electrode 20. The glass envelope 16 includes a rectangular faceplate portion 22 having a major axis X—X and a minor axis Y—Y (see FIG. 2), a funnel portion 24 and a neck portion 26. The three-color phosphor viewing screen structure 18 is supported on the inner surface of the faceplate portion 22. The viewing screen structure 18 is preferably a line-screen structure with phosphor lines extending parallel to the minor axis Y—Y of the faceplate 22.

The apertured-mask electrode 20 is positioned in the envelope 16 in a predetermined spaced relationship with the viewing screen structure 18. The apertured-mask electrode 20 used with the line-screen structure 18 includes slot-shaped apertures (not shown). The slot-shaped apertures are positioned parallel to the phosphor lines of the viewing screen structure 18.

Figure 2:
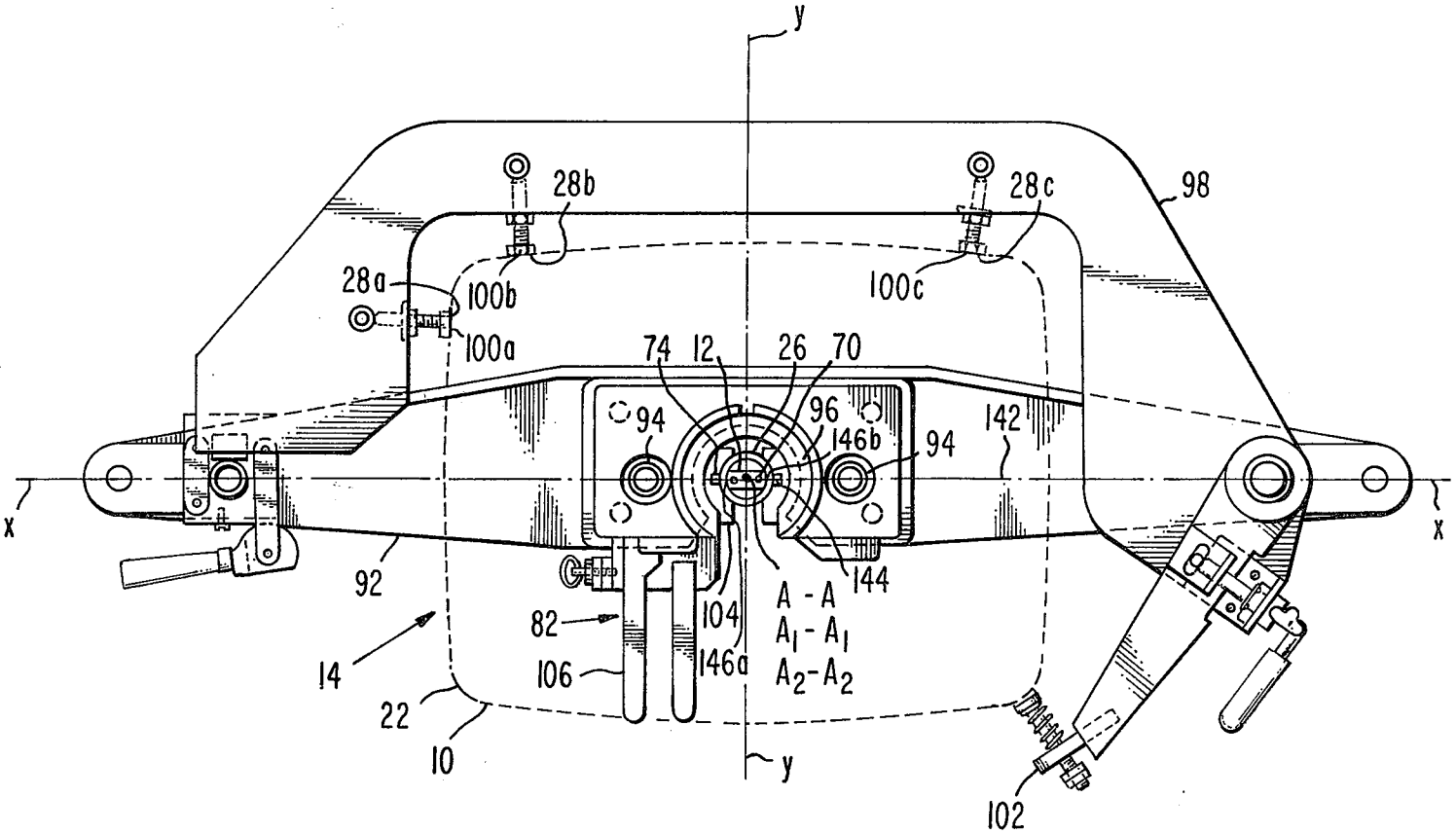
FIG. 2 is a plan view of the head assembly and bulb assembly shown in FIG. 1.

As stated previously, the faceplate panel portion 22 is preferably of a rectangular shape and includes three reference surfaces 28*a*, 28*b* and 28*c* as shown in FIG. 2. The reference surface 28*a* defines one of the smaller sides, and the reference surfaces 28*b* and 28*c* define one of the larger sides of the rectangularly shaped faceplate portion 22. The reference surfaces also define the position of the major axis X—X and the minor axis Y—Y for the faceplate portion 22, the minor axis Y—Y being perpendicular to the major axis X—X. The central longitudinal axis A—A of the bulb assembly 10 passes centrally through the neck portion 26 and the intersection of the major axis X—X and the minor axis Y—Y.

Figure 3:
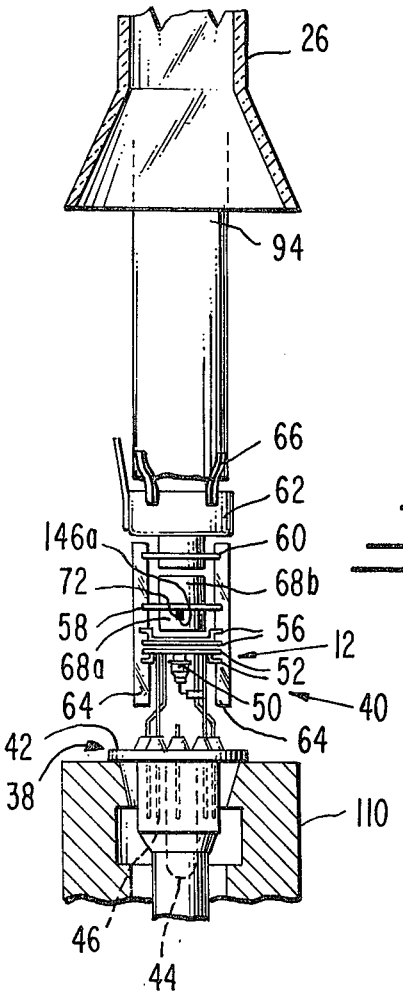
FIG. 3 is an enlarged elevational view of a portion of FIG. 1 further illustrating a mount assembly positioned on a mount support assembly of the mount sealing unit.

As shown in FIG. 3, the mount assembly 12 comprises a stem assembly 38 and a multi-beam electron gun assembly 40. The stem assembly 38 includes a stem 42, exhaust tubulation 44 and stem leads 46. The stem leads 46 are located on the circumference of a circle which is concentric with the central longitudinal axis $A_1$—$A_1$ of the mount assembly 12. The multi-beam electron gun assembly 40 includes three cathodes 50, a control grid or G1 grid 52, a screen grid or G2 grid 56, a first accelerating and focusing grid or G3 grid 58, a second accelerating and focusing grid or G4 grid 60, and a shield cap 62. The various grids are mounted on glass support rods 64. The shield cap 62 may also include bulb spacers 66 for centering the gun assembly within the neck portion 26.

The multi-beam electron gun assembly 40 is preferably of the type known in the art as "in-line". An in-line electron gun assembly includes three equally spaced coplanar cathodes, one for each electron beam. In one preferred in-line electron gun assembly, such as described in U.S. Pat. No. 3,772,554 issued to R. H. Hughes, the grid electrodes for all three cathodes are each formed in one piece. For example, the G1 grid 52, G2 grid 56, G3 grid 58 and G4 grid 60 are each one piece, each having three apertures, one for each electron beam.

In the in-line electron gun assembly 40 shown in FIG. 3, the G3 grid 58 is formed in the shape of a lower cup 68*a* and an upper cup 68*b* attached at their open ends. Each of the cups includes three in-line apertures 70 (see FIG. 2), one for each of the three cathodes 50. The lower cup 68*a* is formed with a pair of narrow slits 72*a* and 72*b* on opposite ends thereof. The narrow slits 72*a* and 72*b* lie within a plane formed by a center line 74 through the apertures 70 (see FIG. 2) and the central longitudinal axes $A_1$—$A_1$ of the mount assembly. The central longitudinal axis $A_1$—$A_1$ of the mount assembly 12 is also coincident with the axis of the center cathode.

It is preferred that a multi-head rotary sealing unit 14, partially shown in FIG. 1, be used to practice the method disclosed herein. The rotary unit includes separate processing stations for loading, preheating, sealing, annealing and unloading. The sealing unit 14 includes a rotatable head assembly 76, having a central longitudinal axis $A_2$—$A_2$, for each processing station. The head assembly 76 includes a support-frame assembly 78, a bulb alignment assembly 80, a neck chuck 82, a mount support assembly 84, a mount rotating fixture 86 and a sealing fire assembly (schematically shown by arrow 88).

The support-frame assembly 78 includes a lower support 90 and an upper support 92. The lower support 90 is rotatably mounted on the mount sealing unit 14 in bearings (not shown). The lower support 90 includes two vertical support rods 94. The upper support 92 is mounted on top of the two support rods 94. The upper support 92 includes a bulb support member 96 formed to hold the bulb assembly at a specified diameter on the funnel portion 24 known as the yoke reference line.

The bulb alignment assembly 80 is also mounted on the upper support 92. The bulb alignment assembly 80 includes a C-shaped support 98 having three reference units 100*a*, 100*b* and 100*c* for orienting the bulb assembly 10 and a bulb clamp assembly 102 for retaining the bulb assembly 10 against the three reference units as shown in FIGS. 1 and 2. The neck chuck 82 is mounted on the two vertical rods 94. The neck chuck 82 comprises two jaws 104 and actuating means 106 for equally moving the jaws.

As shown in FIG. 1, the mount support assembly 84 is mounted on the lower support 90. The mount support assembly 84 includes a mount seal spindle 108 and a mount pin 110. The mount seal spindle 108 is slidably mounted in the lower support 90. The lower end of the mount seal spindle 108 slides on a vertically displaced track (not shown) during indexing of the sealing unit 14.

Figure 4:
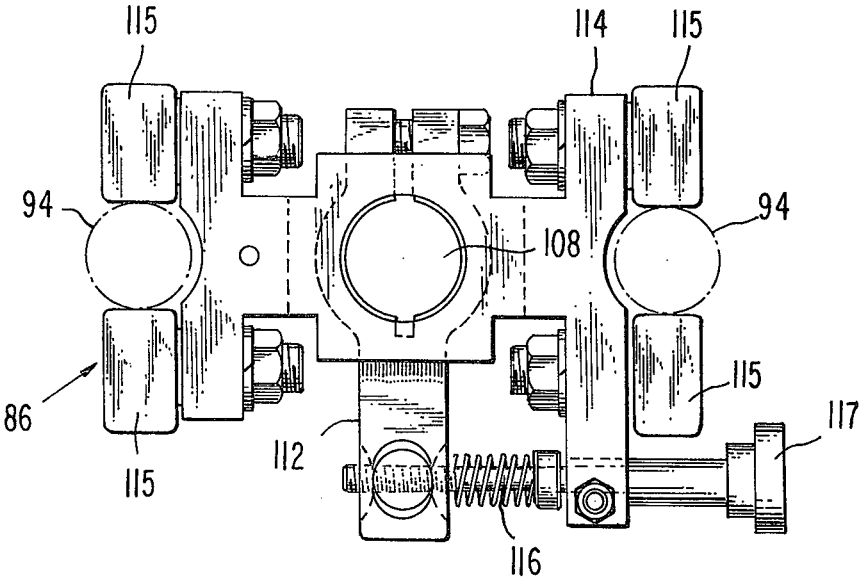
FIG. 4 is a plan view of a mount rotating fixture.

The mount rotating fixture 86 is mounted on the mount seal spindle 108 of the mount support assembly 84. The mount alignment fixture 86 is constructed to slidably contact the two vertical support rods 94 to prevent undesired rotational movement of the mount support assembly 84 about the central longitudinal axis $A_2$—$A_2$ while permitting longitudinal movement along the $A_2$—$A_2$ axis. The mount rotating fixture 86 also includes means for adjusting the rotational orientation of the mount assembly 12 with respect to the major axis X—X of the faceplate 22 prior to the insertion of the mount assembly 12 in the neck portion 26 of the bulb assembly 10. As shown in FIG. 4, the mount rotating fixture 86 comprises a spindle alignment arm 112 which is rigidly fastened to the mount seal spindle 108 and a fixture body 114 having rollers 115 which roll along the two vertical support rods 94. The rotational adjusting means comprises adjusting knob 117 on an alignment screw 116 which extends through the fixture body 114 and engages a threaded portion on the spindle alignment arm 112. Turning the adjusting knob 117 causes the spindle alignment arm 112 to rotate with respect to the fixture body 114. Since the fixture body 114 is fixed with respect to the central longitudinal axis $A_2$—$A_2$, the rotational adjusting means controls the rotational orientation of the spindle alignment arm 112 about the central longitudinal axis $A_2$—$A_2$.

Figure 5:
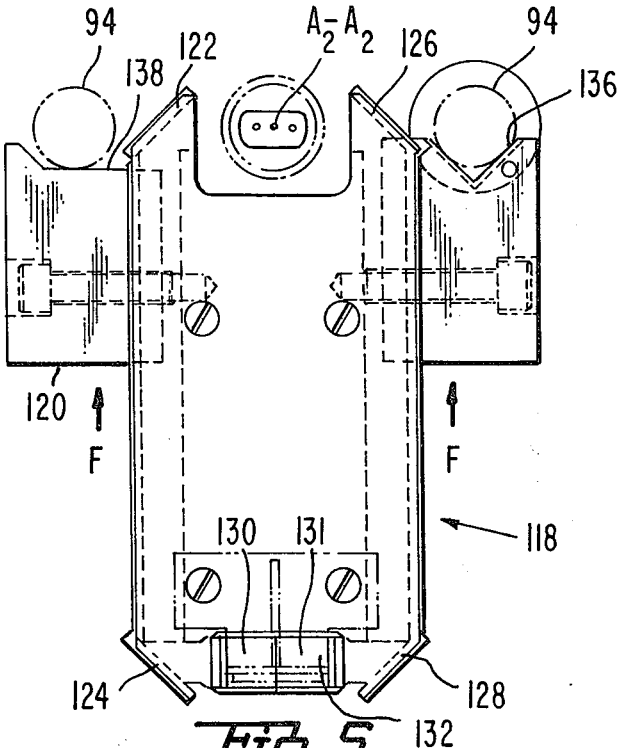
FIG. 5 is a plan view of an optical rotational orientation sensing apparatus as used with an in-line electron gun.
Figure 6:
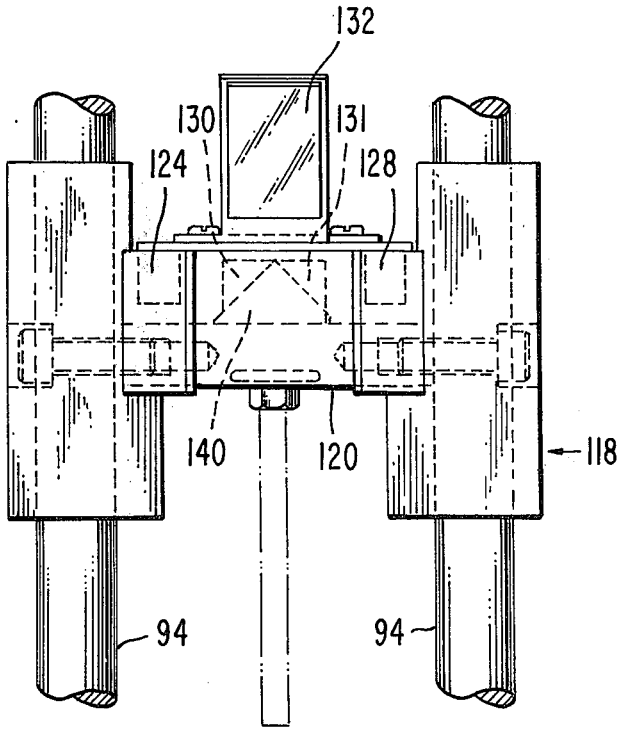
FIG. 6 is an elevational view of the optical orientation sensing apparatus of FIG. 5.

The main sealing unit 14 also includes means attachable thereto for optically sending the rotational orientation of the mount assembly 12 with respect to the major axis X—X of the faceplate 22. As shown in FIGS. 5 and 6, the optical sensing means 118 comprises an aligner body 120, a first image collecting mirror 122, a first image directing mirror 124, a second image collecting mirror 126, a second image directing mirror 128, a first imaging prism 130, a second imaging prism 131 and a viewing mirror 132. Each of the mirrors used in the optical sensing means 118 is preferably a first surface mirror having a substantially planar reflecting surface.

The aligner body 120 includes one V-shaped surface 136 and one flat surface 138. The aligner body 120 is constructed to contact the two vertical support rods 94 when in sensing position. The first and second image collecting mirrors 122 and 126 are mounted on the aligner body 120. The planar reflecting surfaces of the first and second image collecting mirrors face toward the central longitudinal axis $A_2$—$A_2$ of the head assembly 76 and the first and second image directing mirrors 124 and 128 respectively, intersecting, at a 45° angle, a first plane which is parallel to the vertical rods 94 and contains the $A_2$—$A_2$ axis. The intersecting loci of the first plane with the reflecting surfaces of the first and second image collecting mirrors are parallel to and equidistant from the $A_2$—$A_2$ axis as established by the engagement of the V-shaped surface 136 with one of the vertical support rods 94. The first and second image directing mirrors 124 and 128 are also mounted on the aligner body, the planar reflecting surface of each facing toward each other and intersecting, at a 45° angle, a second plane which is parallel to the vertical support rods. The intersecting loci of the second plane with the reflecting surfaces of the first and second image directing mirrors are parallel to the $A_2$—$A_2$ axis.

The first and second imaging prisms 130 and 131 are mounted adjacent each other on a prism mount 140 which is mounted on the aligner body 120 in the second plane equidistant between the frst and second image directing mirrors 124 and 128. The reflecting surfaces of the first and second imaging prisms 130 and 131 intersect the second plane at right angles, the intersecting locus of the second plane and the first prism 130 forming a 45° angle with the intersecting locus of the first image directing mirror 124 and the intersecting locus of the second plane and the second prism 131 forming a 45° angle with the intersecting locus of the second image directing mirror 128. The viewing mirror 132 is mounted directly above the first and second imaging prisms 130 and 131, the reflecting surface facing toward the prism and positioned as required to provide a convenient viewing area.

The rotatable head assembly 76 is initially aligned with an alignment gauge (not shown). The alignment gauge is used to align the central longitudinal axes of the bulb alignment assembly 80 and the neck chuck 82 coincident with the central longitudinal axis of the mount seal spindle 108. These coincident axes establish the central longitudinal axis $A_2$ —$A_2$ of the head assembly 76. The alignment gauge is also used to establish the location of the reference surfaces 28*a*, 28*b* and 28*c* to rotationally position the major axis X—X parallel to the two support rods 94.

A bulb assembly 10 is positioned in the head assembly 76 on a bulb support assembly 78 adapted to hold and orient the bulb assembly 10. The reference surfaces 28*a*, 28*b* and 28*c* are engaged with the reference units 100*a*, 100*b* and 100*c* respectively. The bulb clamp assembly 102 and the neck chuck 82 are operated to position the central longitudinal axis A—A of the bulb assembly 10 coincident with the central longitudinal axis $A_2$—$A_2$ of the head assembly 76. The position of the bulb assembly 10 in the head assembly 76 establishes a reference plane 142 (see FIG. 2) containing the longitudinal central axis A—A of the bulb assembly 10, the plane of the two support rods 94, the major axis X—X and the central longitudinal axis $A_2$—$A_2$ of the head assembly 76.

A mount assembly 12 is then positioned on a mount support assembly 84 adapted to hold and orient the mount assembly 12 with the central longitudinal axis $A_1$—$A_1$ of the mount assembly 12 coincident with the central longitudinal axis A—A of the bulb assembly 10 and central longitudinal axis $A_2$—$A_2$ of the head assembly 76. The mount assembly 12 is positioned on the mount pin 110 with the bottom of the stem 42 substantially in full surface contact (not tilted) with the top surface of the mount pin 110 as shown in FIG. 3. The stem leads 46 are engaged within the mount pin 110 to substantially center the central longitudinal axis $A_1$—$A_1$ of the mount assembly 12 coincident with the central longitudinal axis $A_2$—$A_2$ of the head assembly 76, and consequently coincident with the central longitudinal axis A—A of the bulb assembly 10.

An orientation plane 144 is defined with respect to the structure of the electron gun assembly 40 by selecting a first reference point 146a and a second reference point 146b (see FIGS. 2 and 3) on the electron gun structure. The two points are spaced from each other and radially spaced around the central longitudinal axis $A_1$—$A_1$ of the mount assembly 12. The orientation plane 144 is then defined as that plane which contains the two points 146*a* and 146*b* and a line parallel to the central longitudinal axis $A_1$—$A_1$ of the mount assembly 12. For an in-line multi-beam electron gun assembly as shown in FIGS. 2 and 3, it is preferred that the orientation plane 144 pass through the apertures 70 in the G3 grid 58. Since, as previously stated, the slits 72*a* and 72*b* in the lower cup 68*a* of the G3 grid 58 lie within the plane formed by the center line 74 through the apertures 70 in the G3 grid 58 and the central longitudinal axis $A_1$—$A_1$ of the mount assembly, the orientation plane 144 for the in-line multi-beam electron gun assembly is defined by the slits 72 and the central longitudinal axis $A_1$—$A_1$. To obtain the desired rotational alignment of the in-line multi-beam electron gun assembly 40 with respect to the major axis X—X of the faceplate portion 22, the mount assembly 12 is rotated with respect to the bulb assembly 10 about the coincident central longitudinal axes $A_1$—$A_1$ and A—A until the orientation plane 144 is coincident with the reference plane 142. At this point, the orientation plane 144 is parallel to the major axis X—X and the mount assembly 12 is in proper rotational alignment with respect to the bulb assembly 10.

Figure 7:
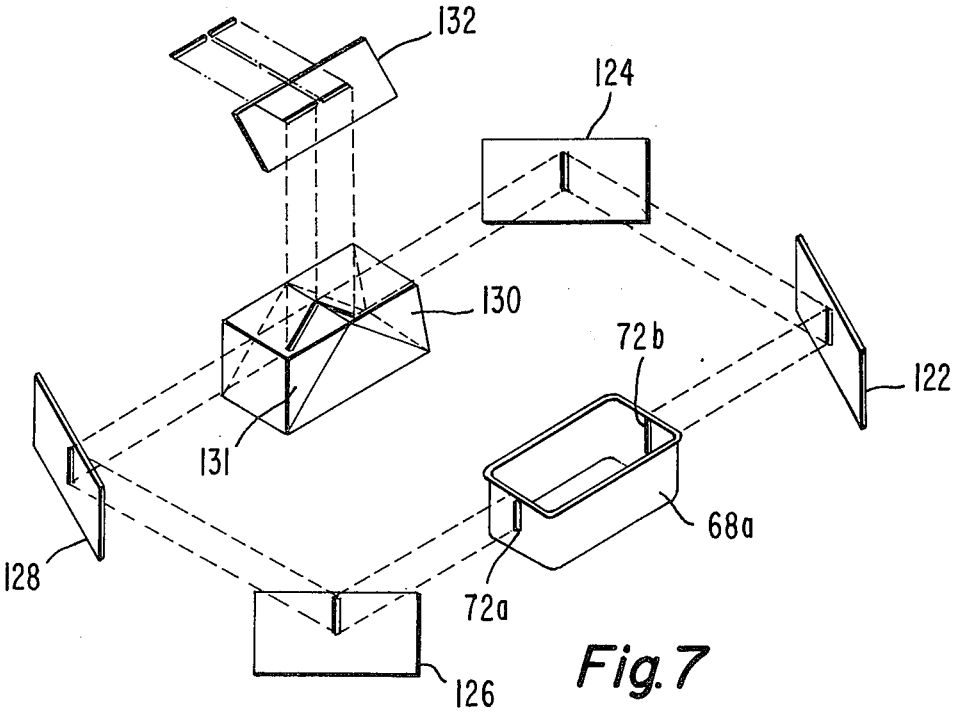
FIG. 7 is a schematic diagram indicating the optical imaging paths of the optical sensing apparatus of FIGS. 5 and 6.
Figure 8A:
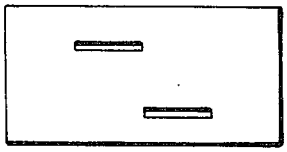
FIGS. 8*a*, 8*b* and 8*c* are a representation of three examples of images displayed by the optical orientation sensing apparatus of FIGS. 5 and 6.
Figure 8B:
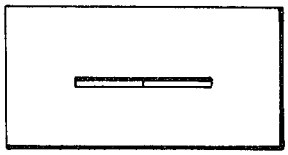
Figure 8C:
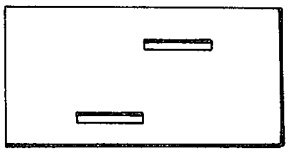

In order to determine the coincidence of the orientation plane 144 with the reference plane 142, the optical sensing means 118 is operated to engage the aligner body 120 with the two vertical rods 94 in position to observe the slits 72*a* and 72*b* in the lower cup of the G3 grid. An engaging arm (not shown) may be used to swing the sensing means 118 into position and to exert a force F (see FIG. 5) to maintain the aligner body 120 in contact with the vertical support rods 94. At this time, the mount assembly 12 may not be precisely at the desired rotational alignment. A display of the two slits 72*a* and 72*b* on the viewing mirror 132 of the optical sensing means 118 will disclose any rotational misalignment. As shown schematically in FIG. 7, the images of the two slits 72*a* and 72*b* in the lower cup 68*a* of the G3 grid are reflected to the viewing mirror 132 by the first and second image collecting mirrors 122 and 126; the first and second image directing mirrors 124 and 128; and the first and second imaging prisms 130 and 131. To facilitate viewing, the slits 72*a* and 72*b* may be illuminated by a separate light source (not shown). Rotational misalignment is indicated when the images of the two slits 72*a* and 72*b* displayed on the viewing mirror 132 are not aligned as shown, for example, in FIGS. 8 (*a*) and 8 (*c*). Rotational misalignment is corrected by turning the knob 117 on the alignment screw 116 of the adjusting means until the images of the two slits are aligned as shown in FIG. 8 (*b*). When the images of the two slits are in alignment on the viewing mirror 132, the orientation plane 144 is coincident with the reference plane 142 and consequently parallel to the major axis X—X. After alignment has been achieved, the optical sensing means 118 is retracted to a standby position.

Note that although the reference points 146*a* and 146*b* are defined by slits 72*a* and 72*b* in the embodiment described herein, any type of visable marks may be used and should be considered as within the scope and intendment of the method disclosed herein.

The mount assembly 12 is then moved along the central longitudinal axis $A_2$—$A_2$ of the head assembly 76 to a desired longitudinal location with respect to the faceplate portion 22 of the bulb assembly 10. The mount assembly 12 is guided within the neck portion 26 by bulb spacers 66 which substantially maintain the center of the in-line electron gun assembly on the central longitudinal axis A—A of the bulb assembly 10. At the desired longitudinal location, the stem 42 is sealed within the neck portion 26. The mount assembly 12 is moved into the neck portion 26 during the cycle of the sealing machine 14 by the vertically displaced track previously described. Finally, the bulb assembly 10 and the mount assembly 12 are permanently fixed together. It is preferred that they are fixed by a seal between the stem 42 and the neck portion 26. During the sealing, the lower part of the neck portion 26, known as the cullet, is removed. The sealing of the bulb assembly 10 and the mount assembly 12 also includes preheating and annealing of the glass, as is well known.

The method describes that the preferred location of the in-line electron gun assembly as parallel to the major axis X—X. The position may also be parallel to the minor axis Y—Y or at any desired angle in between. This may be accomplished with the method disclosed herein, with the two vertical rods 94 rotated 90° or any angle in between 0° and 90° with respect to the bulb alignment assembly.

Although the method describes positioning an in-line electron gun assembly having common electrodes, the method may also be used for other multiple electron gun assemblies having separate individual electrodes for each gun. For example, the method may be used on an in-line or Delta electron gun having individual cylindrical electrodes. Where a mount assembly having three individual cylindrical in-line electron guns is used, the two points which define the orientation plane for the electron gun structure are each chosen to be at the point where the reference plane intersects the end surfaces on each of the two end in-line electron guns. Other points may also be selected or formed on the electron gun structure with the points being precisely positioned a known dimension from the reference plane and the central longitudinal axis $A_1$—$A_1$ of the mount assembly 12 to establish an orientation plane parallel to or coincident with a reference plane through the apertures of the inline electron guns.

Although the method disclosed herein describes the use of an optical sensing means which includes a combination of mirrors and prisms, it should be noted that the optical sensing means can include either all mirrors or all prisms or any combination of mirrors and prisms to perform the functions of image collecting, directing and displaying and all such variations are to be considered within the scope and intendment of this disclosure. In addition, the multiple head main sealing machine is described only as the preferred apparatus for practising the method disclosed herein. This method may also be practised on a single head sealing machine. Also in either apparatus, the head may be held stationary and the fires rotated to make the mount-bulb seal.

The method disclosed herein is suitable, not only for orienting the mount assembly prior to its insertion into the bulb assembly as described above, but is also suitable for conducting quality control type checks of the rotational position of the mount assembly with respect to the bulb assembly after mount sealing has taken place.

We claim:

1. A method of assembling a cathode ray tube, said tube including a bulb assembly and a mount assembly, said bulb assembly having a central longitudinal axis and including a faceplate panel having a transverse axis, said mount assembly having a central longitudinal axis and including a multi-beam electron gun assembly having at least two reference points on the structure thereof, said reference points being spaced from each other and radially spaced around the central longitudinal axis of said mount assembly, said method comprising the steps of:

a. positioning said bulb assembly in a predetermined orientation;

b. positioning said mount assembly in a location spaced from said bulb assembly with the central longitudinal axis thereof coincident with the central longitudinal axis of said bulb assembly;

c. optically sensing the rotational position of said electron gun assembly about said coincident longitudinal axes with respect to said positioned bulb assembly by comparing the relative positions of said reference points on an optical display;

d. adjusting the relative positions of said reference points on the optical display by rotating said mount assembly about said coincident longitudinal axes until said reference points are in predetermined relative positions whereby said electron gun assembly is at a prescribed rotational orientation with respect to said bulb assembly;

e. then, while maintaining said rotational orientation, moving said mount assembly along said longitudinal axis to a desired longitudinal location with respect to the faceplate panel of said bulb;

f. and then permanently fixing said mount assembly to said bulb assembly.

2. The method in accordance with claim 1 in which step a includes establishing a reference plane containing the central longitudinal axis of the bulb assembly and the transverse axis of the faceplate panel.

3. The method in accordance with claim 2 in which step c comprises the steps of defining an orientation plane parallel to the central longitudinal axis of the mount assembly, said orientation plane including said two reference points on the structure of said electron gun assembly, and sensing the position of said orientation plane with respect to said reference plane by optically sensing the position of said reference points with respect to each other.

4. The method in accordance with claim 3 in which step c includes the step of defining said orientation plane to be in parallel spaced relation to said reference plane when said electron gun assembly is in proper alignment with respect to said bulb assembly.

5. The method in accordance with claim 4 in which step d comprises rotating said mount assembly about said coincident longitudinal axes until said orientation plane is in parallel spaced relation to said reference plane as indicated by the alignment of said two reference points on a split image optical display.

6. The method in accordance with claim 3 wherein said electron gun assembly comprises an in-line electron gun having at least one common grid, said common grid having three in-line electron beam apertures therein, the center aperture being coincident with the central longitudinal axis of the mount assembly, and step c includes the step of defining said orientation plane through said in-line electron beam apertures, said orientation plane including the central longitudinal axis of the mount assembly and two reference points located on opposite sides of said common grid.

7. The method in accordance with claim 6 wherein said tube includes a phosphor line screen, said phosphor lines being substantially perpendicular to said transverse axis, and step c includes the step of defining said orientation plane to be coincident with said reference plane when said in-line electron gun assembly is in proper alignment with respect to said bulb assembly.

8. The method in accordance with claim 7 in which step d comprises rotating said mount assembly about said coincident longitudinal axes until said orientation plane is coincident with said reference plane as indicated by the alignment of said two reference points on a split image optical display.

9. A method of assembling a color television picture tube, said tube including a bulb assembly having a central longitudinal axis, a rectangular faceplate panel having a major and a minor axis, and a neck portion; and a mount assembly having a central longitudinal axis and including a multi-beam electron gun assembly and a stem assembly, said method comprising the steps of:

a. positioning said bulb assembly on a bulb support adapted to hold the bulb assembly in a predetermined orientation with respect to the central longitudinal axis thereof and one of the major or minor axes thereof;

b. positioning said mount assembly on a rotatable mount support adapted to hold said mount assembly with the central longitudinal axis of said mount assembly coincident with the longitudinal axis of said bulb assembly;

c. moving an optical alignment means into contact with said bulb support to orient said optical alignment means with respect to a reference plane through the longitudinal axis of said bulb assembly and one of said major or minor axes;

d. optically sensing two preselected, spaced reference points on the structure of said electron gun assembly, said points defining an orientation plane that passes through the apertures of at least two electron guns and is parallel to the central longitudinal axis of said mount assembly;

e. optically comparing the relative positions of said two reference points on a split-image optical display;

f. rotating said mount assembly in said mount support until said two reference points are aligned on the split-image optical display, whereby said orientation plane through said electron-gun apertures is substantially parallel to said reference plane;

g. then, while maintaining said rotational orientation and coincident longitudinal axis, axially moving said mount assembly into said bulb until the stem assembly is in the desired longitudinal position with respect to said faceplate panel;

h. and then sealing said stem assembly and said neck assembly to form a color television picture tube assembly.

10. A method of assembling a color television picture tube, said tube including a bulb assembly having a central longitudinal axis, a rectangular faceplate panel having a major axis and a minor axis, a phosphor line screen, said phosphor lines being substantially perpendicular to said major axis, and a neck portion; and a mount assembly having a central longitudinal axis and including a multi-beam electron gun assembly having three in-line electron beam apertures, and a stem assembly, said method comprising the steps of:

a. positioning said bulb assembly on a bulb support adapted to hold the bulb assembly in a predetermined orientation with respect to the central longitudinal axis thereof and the major axis of the faceplate panel;

b. positioning said mount assembly on a rotatable mount support adapted to hold said mount assembly with the central longitudinal axis of said mount assembly coincident with the longitudinal axis of sad bulb assembly;

c. moving an optical alignment means into contact with said bulb support to orient said optical alignment means with respect to a reference plane through the longitudinal axis of said bulb assembly and said major axis of the faceplate panel;

d. optically sensing two preselcted, spaced reference points on the structure of said electron gun assembly, said points defining an orientation plane that passes through said electron beam apertures and contains the central longitudinal axis of said mount assembly;

e. optically comparing the relative positions of said two reference points on a split-image optical display;

f. rotating said mount assembly in said mount support until said two reference points are aligned on the split-image optical display, whereby said orientation plane through said electron-beam apertures is substantially coincident with said reference plane;

g. then, while maintaining said rotational orientation and coincident longitudinal axes, axially moving said mount assembly into said bulb assembly until the stem assembly is in the desired longitudinal position with respect to said faceplate panel;

h. and then sealing said stem assembly and said neck assembly to form a color television pictue tube assembly.

* * * * *

UNITED STATES PATENT OFFICE
CERTIFICATE OF CORRECTION

PATENT NO. : 3,962,764

DATED : June 15, 1976

INVENTOR(S) : John Franklin Stewart et al.

It is certified that error appears in the above-identified patent and that said Letters Patent are hereby corrected as shown below:

In the Abstract, lines 11 and 12, "structures" should read --structure--. Column 4, line 68 "alignment" should read --rotating--. Column 5, line 65, "frst" should read --first--.

Signed and Sealed this

Seventh Day of September 1976

[SEAL]

*Attest:*

RUTH C. MASON
*Attesting Officer*

C. MARSHALL DANN
*Commissioner of Patents and Trademarks*